United States Patent [19]

Johnson et al.

[11] 3,960,993

[45] June 1, 1976

[54] METHOD FOR EXTRUDING SOLVENTLESS GUN POWDER

[75] Inventors: Craig E. Johnson, Indian Head; John R. Luense, Marlow Heights, both of Md.

[73] Assignee: The United States of America as represented by the Secretary of the Navy, Washington, D.C.

[22] Filed: Feb. 27, 1975

[21] Appl. No.: 553,719

[52] U.S. Cl. ..... 264/3 B; 149/96

[51] Int. Cl.[2] ..... C06B 21/00

[58] Field of Search ..... 149/96, 120; 264/3 B

[56] References Cited

UNITED STATES PATENTS

| | | | |
|---|---|---|---|
| 2,479,727 | 8/1949 | Daniels | 264/3 B |
| 2,994,106 | 8/1961 | Posey | 264/3 B |
| 3,447,983 | 6/1969 | Camp et al. | 149/96 X |
| 3,711,344 | 1/1973 | Pierce | 149/96 X |
| 3,723,207 | 3/1973 | Camp | 149/96 X |
| 3,844,856 | 10/1974 | Flynn et al. | 149/96 X |

*Primary Examiner*—Edward A. Miller
*Attorney, Agent, or Firm*—R. S. Sciascia; Paul S. Collignon

[57] ABSTRACT

A method for extruding solventless gun powder comprising working and reforming said gun powder by extruding through a plurality of holes in at least two plates prior to final extrusion through a die whereby said solventless gun powder has improved tensile strength.

4 Claims, 3 Drawing Figures

METHOD FOR EXTRUDING SOLVENTLESS GUN POWDER

BACKGROUND OF THE INVENTION

Pyrotechnic charges are frequently made by either a casting or an extruding process. Each process is particularly adaptable to specific pyrotechnic compositions and some compositions cannot be cast while others cannot be extruded.

One such casting process for a propellant charge is shown and described in U.S. Pat. No. 3,678,138, entitled, "Solid Propellant Charge Making In Mold Having Perforated Separator Means," which issued July 18, 1972, to Stuart Gordon et al. In this process casting powder, which is principally nitrocellulose, is placed in a mould and a casting liquid is forced through the powder by gas pressure using an inert gas. The propellant is allowed to cure in the mould and, after curing the mould is separated and the propellant charge removed.

An extruding process for forming a pyrotechnic composition is shown and described in U.S. Pat. No. 3,418,686, entitled, "Apparatus For Forming Rocket Propellant Grains," which issued Dec. 31, 1968, to Richard G. Guenter. In this process, an axially movable ram is utilized to extrude propellant through a multiplicity of orifices. The movement of the extruded material is opposed or retarded by a disc shaped consolidation ram positioned in a die segment. The retarding of the movement of the material results in a product having a large propellant grain while at the same time relieving the stresses and strains generated by the extrusion.

SUMMARY OF THE INVENTION

The present invention relates to a process for improving the tensile strength of solventless gun powder which is extruded to a final diameter. The gun powder is first loaded into a vacuum press and a vacuum is pulled prior to extrusion. The gun powder is passed through at least two plates having a plurality of holes and the composition is reformed after each pass. The final diameter of the composition is provided by extruding through a die.

It is therefore a general object of the present invention to provide a process for improving the tensile strength of solventless gun powder which is formed by an extrusion process.

Other objects, advantages and novel features of the invention will become apparent from the following detailed description of the invention when considered in conjunction with the accompanying drawing.

DESCRIPTION OF THE PREFERRED EMBODIMENT

Figure 1:
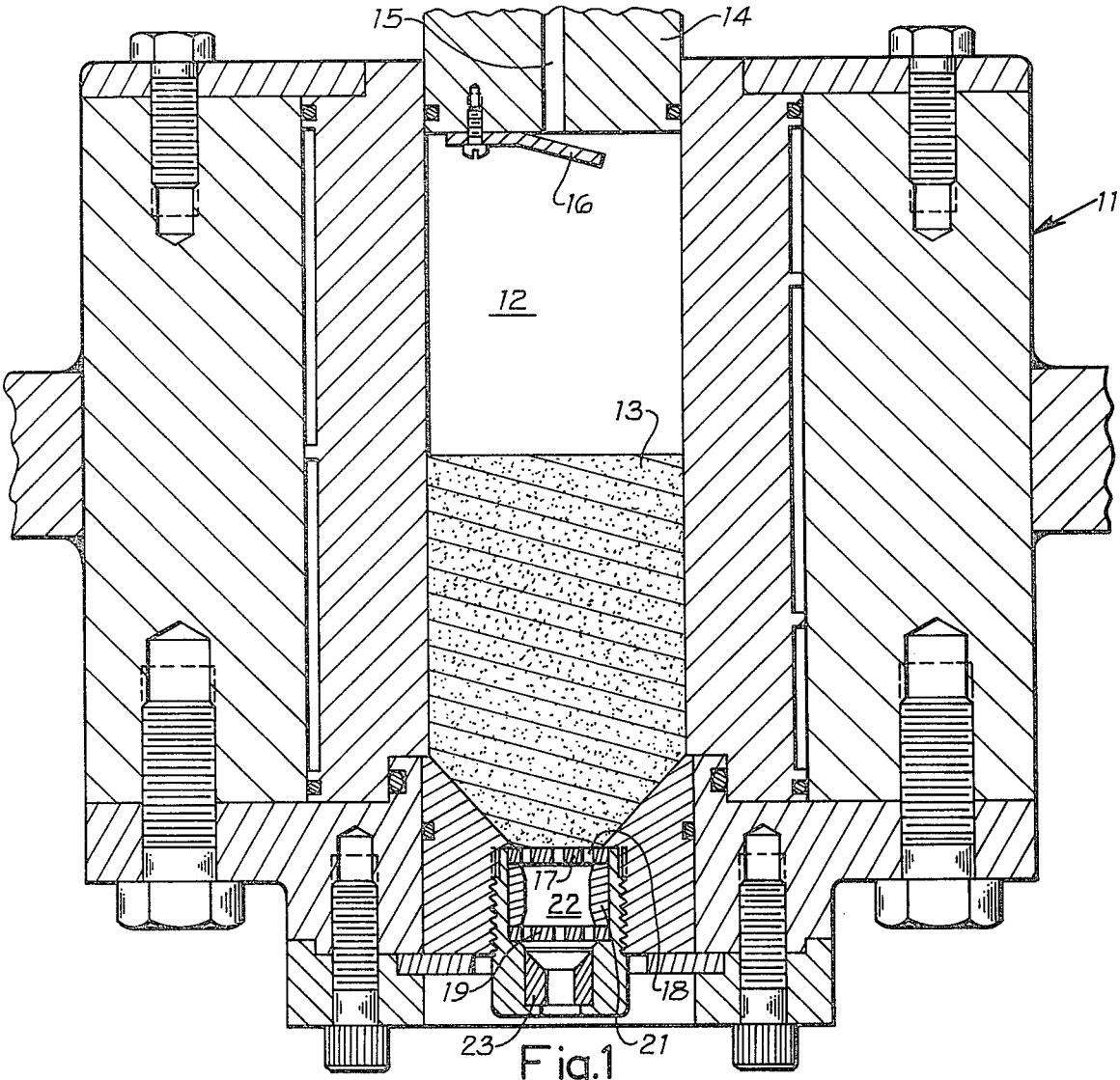
FIG. 1 is a partial longitudinal section of an extrusion device showing die members for processing solventless gun powder.
Figure 2:
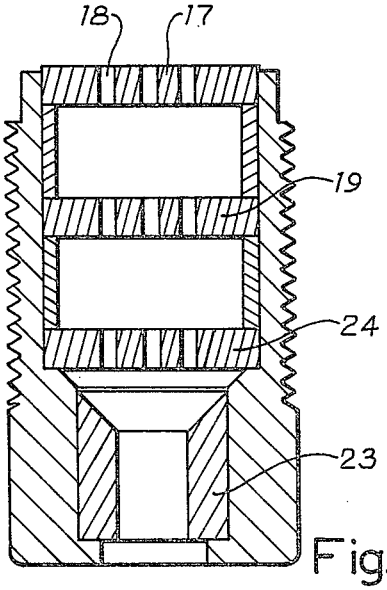
FIG. 2 is a sectional view showing another arrangement of die members.

Referring now to the drawing, there is shown a vacuum press 11 having a press basket 12 into which a quantity of solventless gun powder 13 is loaded. A ram 14 is provided to extrude the gun powder 13 through a series of dies in the lower end of press 11. By way of example, solventless gun powder 13 might be comprised of 46 percent of nitrocellulose (12 percent N), 38.5 percent of metriol tri-nitrate, 3 percent of tri-ethylene glycol di-nitrate, 8.4 percent of di-butyl phthalate, 2 percent of ethyl centralite, 1 percent of potassium sulfate, 1 percent of lead carbonate and 0.1 percent of candellia wax. A small orifice 15 is provided in ram 14 so that a vacuum can be pulled in basket 12 prior to extruding the gun powder through the series of dies. A flapper 16 is attached to the bottom of ram 14 and is of flexible material so that flapper 16 will close orifice 16 when ram 14 engages gun powder 13.

Figure 3:
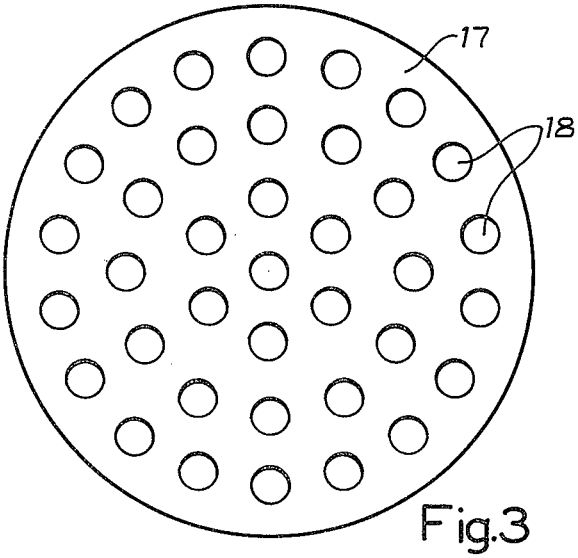
FIG. 3 is a plan view of a die member having a plurality of holes.

When ram 14 is lowered, it engages gun powder 13 and extrudes it through plate 17. As shown in FIGS. 1 and 3 of the drawing, plate 17 is provided with a plurality of holes 18 and as gun powder 13 is forced through the holes 18 in plate 17 it is worked thereby increasing its tensile strength. A second plate 19, similar to plate 17, is spaced apart from plate 17 by spacer 21 thereby providing a space 22 whereby the powder extruded through plate 17 is reformed into a mass and then extruded through the holes in plate 19. The powder is again reformed into a mass after passing through the holes in plate 19 and is then extruded through die 23.

In FIG. 3 of the drawing, there is shown another embodiment wherein a third plate 24 is provided. Plates 17, 19, and 24 can be identical and after the solventless gun powder passes through the holes in each plate the gun powder is reformed and then finally passed through die 23 which forms the extruded gun powder into its final shape. The gun powder is worked as it passes through each plate thereby be improved in tensile strength.

By way of example, a quantity of solventless gun powder having the above-listed formula was processed according to the teachings of the present invention. Prior to passing through a plate, the composition was not cohesive and the composition could not even be tested for tensile strength. After passing through one plate, the gun powder composition had a tensile strength of 761 psi at an elongation of 25.28 percent. After passing through two plates the same composition had a tensile strength of 791 psi at an elongation of 23.56 percent and after passing through three plates, the gun powder composition had a tensile strength of 875 psi at an elongation of 24.75 percent.

It can thus be seen that the present invention greatly improves the physical properties of solventless gun powder so that it can be more readily handled in a production process.

Obviously many modifications and variations of the present invention are possible in the light of the above teachings. It is therefore to be understood that within the scope of the appended claims the invention may be practiced otherwise than as specifically described.

We claim:

1. A process for increasing the tensile strength of solventless gun powder comprised, by weight, of about 46 percent nitrocellulose, about 38 percent metriol tri-nitrate, and about 3 percent of tri-ethylene glycol di-nitrate, with the balance being plasticizers and stabilizers, which process comprises the steps of first extruding said solventless gun powder through a multi-hole plate, then reforming said solventless gun powder into a mass, then again extruding said solventless gun powder through a multi-hole plate, then again reforming said solventless gun powder into a mass, and finally extruding said solventless gun powder through a single hole die to form a single strand of solventless gun powder having increased tensile strength wherein said steps are carried out in a vacuum press under a vacuum condition.

2. A process for increasing the tensile strength of a solventless gun powder as set forth in claim 1 wherein the steps of said process are carried out progressively through a series of dies under a vacuum condition.

3. A process for increasing the tensile strength of a solventless gun powder as set forth in claim 2 wherein said solventless gun powder is heated at a temperature between 100° F. and 160° F. during processing.

4. A process for increasing the tensile strength of a solventless gun powder as set forth in claim 1 wherein said gun powder is extruded a third time through a multi-hole plate and reformed into a mass prior to the final extruding step.

* * * * *